US008450705B1

(12) United States Patent
Chen et al.

(10) Patent No.: US 8,450,705 B1
(45) Date of Patent: May 28, 2013

(54) LIGHTING APPARATUS FOR NAIL BEAUTY

(75) Inventors: Chien-Yuan Chen, New Taipei (TW); Ying-Te Chuang, New Taipei (TW); Chien-Chung Chen, New Taipei (TW); Mei-Chun Chiu, New Taipei (TW)

(73) Assignees: Power Digital Delight Co., Ltd., New Taipei (TW); Easthill Industrial Co., Ltd., Taipei (TW)

( * ) Notice: Subject to any disclaimer, the term of this patent is extended or adjusted under 35 U.S.C. 154(b) by 0 days.

(21) Appl. No.: 13/615,628

(22) Filed: Sep. 14, 2012

(51) Int. Cl.
*F26B 3/28* (2006.01)

(52) U.S. Cl.
CPC ..... *F26B 3/28* (2013.01)
USPC ..... 250/492.1

(58) Field of Classification Search
USPC ..... 250/492.1
See application file for complete search history.

(56) References Cited

U.S. PATENT DOCUMENTS

2006/0285323 A1* 12/2006 Fowler ..... 362/230
2010/0293805 A1* 11/2010 Chang ..... 34/202

* cited by examiner

*Primary Examiner* — Kiet T Nguyen
(74) *Attorney, Agent, or Firm* — Leong C. Lei

(57) ABSTRACT

The present invention provides a lighting apparatus for nail beauty comprising a bottom plate having a shape non-restricted to any form and a housing having an arched main body attached to the bottom plate to form a space therebetween; characterized in that: a plurality of lighting modules are provided on a top and two lateral sides of the housing to form a ring array; the lighting modules comprise light sources and heat sinks; the lighting modules provided on the top of the housing are tilted slightly such that light emitted therefrom is shone toward the front end of the apparatus and toward the area opposite of the opening of the space between the housing and the bottom plate. Therefore, fewer light sources are required for uniform UV lighting on the nails and the reflection of UV light out to the external of the apparatus can be prevented for safer uses.

6 Claims, 5 Drawing Sheets

LIGHTING APPARATUS FOR NAIL BEAUTY

(A) TECHNICAL FIELD OF THE INVENTION

The present invention is related to a lighting apparatus for nail beauty, in particular, to an ultraviolet (UV) lighting apparatus for nail art paintings or nail beauty salons.

(B) DESCRIPTION OF THE PRIOR ART

Nail beauty includes such as nail arts, nail sculpture and nail paintings, which mostly utilize nail polishes, crystal slats and adhesives in combination to create nail arts and colors onto finger or toe nails. In addition, for those nail arts that require multiple layers of coloring, paintings or sculptures during the process of creation, it is necessary to await the drying of the nail polishes or the adhesives used for creation among various steps of the creation in order to carry out all the required steps in sequence. To shortening such awaiting of time for the drying of nail polishes or adhesives, an UV lighting device is now often used for faster drying and curing of nail polishes or adhesives into solid forms. Taiwanese Patent Number M427838 discloses one of such UV lighting device that is common to the field of nail arts.

As shown in FIGS. 6 and 7, a conventional lighting device for nail beauty is disclosed. Such known lighting device mainly comprises a box-shaped housing 50 with an opening 51 and a plurality of light sources 60 disposed on top of the internal of the housing 50. The light sources 60, in most cases, are UV LEDs. In addition, in order to provide lighting for different sizes of finger or toe nails placed within the lighting device and to allow either the left/right finger or toe nails to receive sufficient light, the light sources 60 disposed on top of the internal of the housing 50 are often arranged into a matrix. Despite the fact that the area of illumination can be increased with such matrix arrangement of light sources 60 in the UV lighting device, the UV light emitted by the light sources 60 is, however, being projected onto the hand or foot in a vertical direction from top to bottom, which can cause skin damages to the hands and feet in a long run as they are being exposed to UV lighting or radiation in greater areas.

With regard to the manufacturing of the abovementioned known lighting device, the bottom 52 of the box-shaped housing 50 is of a silver or bare metal color, which may to appealing to the eye but also increases the direct or indirect reflection of the UV light emitted from the greater area of light sources 60. In other words, the UV light often escapes to the external of the housing 50 via the opening 50 thereof due to the great reflection and refraction in the housing 50. A test result reveals that the arm and eyes or face of the user of such known UV lighting device are being exposed to a significant amount of UV light, which causes dangers to the user and is hazardous to the human body. This is one of the major drawbacks of the known UV lighting device with UV light sources that needs to be improved to reduce such danger and hazard.

Furthermore, due to the closely disposed or arranged light sources 60 in the housing 50 as mentioned above, a great amount of heat is being generated by these light sources 60 and is conducted to the housing 50, which requires a larger fan or a fan with greater power in order to dissipate the heat, and in turn, the size and manufacturing costs of the device would be increased. This is another drawback of the known UV lighting device that needs to be overcome.

SUMMARY OF THE INVENTION

An objective of the present invention is to provide a lighting apparatus for nail beauty, said lighting apparatus comprises a bottom plate of any shape and an arched housing to form a lighting space, which is characterized in that: a plurality of lighting modules are provided on the top and two sides of the housing to form a ring array of light; the lighting modules comprise light sources and heat sinks; the lighting modules provided on the top of the housing are tilted slightly such that light emitted therefrom is shone toward a front end of the lighting apparatus and toward an extended area opposite of an opening of said space formed between said housing and said bottom plate. Therefore, the light provided by the lighting apparatus of the present invention can be concentrated onto the nail and the nail with a natural curvature is able to receive UV light from all directions uniformly, whereby the escape of the UV light out of the housing to the external of the lighting apparatus can be effectively prevented and the operation of the lighting apparatus can be made safer without excessive use of energy.

Another objective of the present invention is to provide a, lighting apparatus having the housing with an indented portion configured on a top portion thereof. The indented portion provided thereon is to allow the light emitted from the lighting modules thereof to be directed toward the front end of the lighting apparatus and toward the extended area opposite of the opening of the space formed between the housing and the bottom plate, whereby the arrangement or configuration of the lighting modules is of a stable and firm structure.

Still another objective of the present invention is to provide a lighting apparatus for nail beauty having the bottom plate or an inner surface of the housing treated with a black coating such that the escape of the UV light out of the housing to the external of the lighting apparatus can be prevented, making the use and operation of the lighting apparatus safer.

DETAILED DESCRIPTION OF THE PREFERRED EMBODIMENTS

Figure 1:
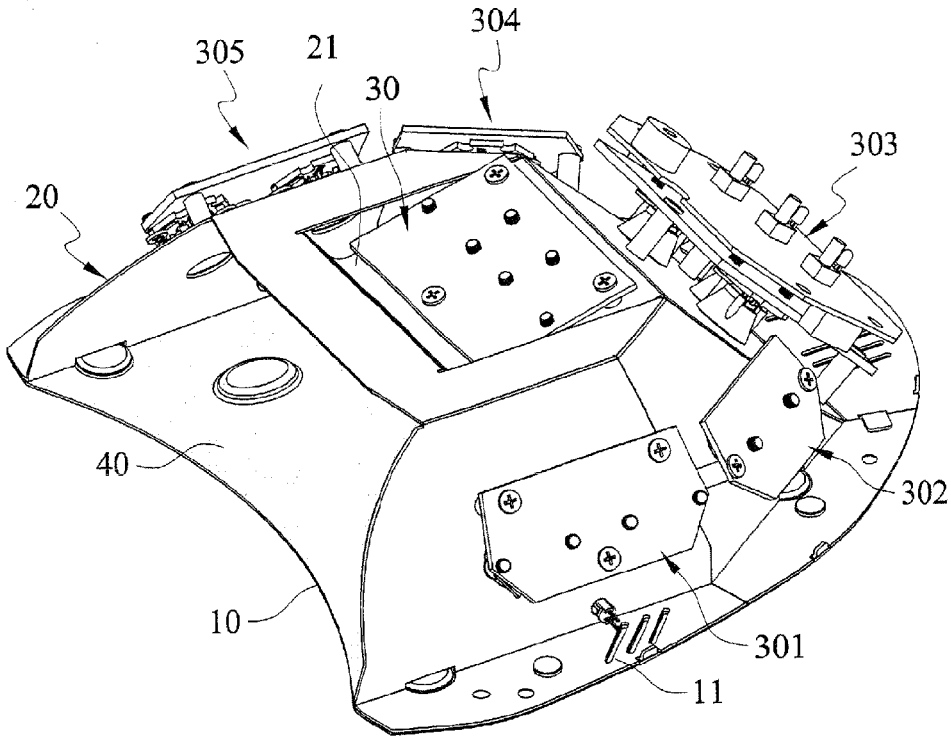
FIG. 1 is a perspective view showing the main components of the lighting apparatus of the present invention.
Figure 2:
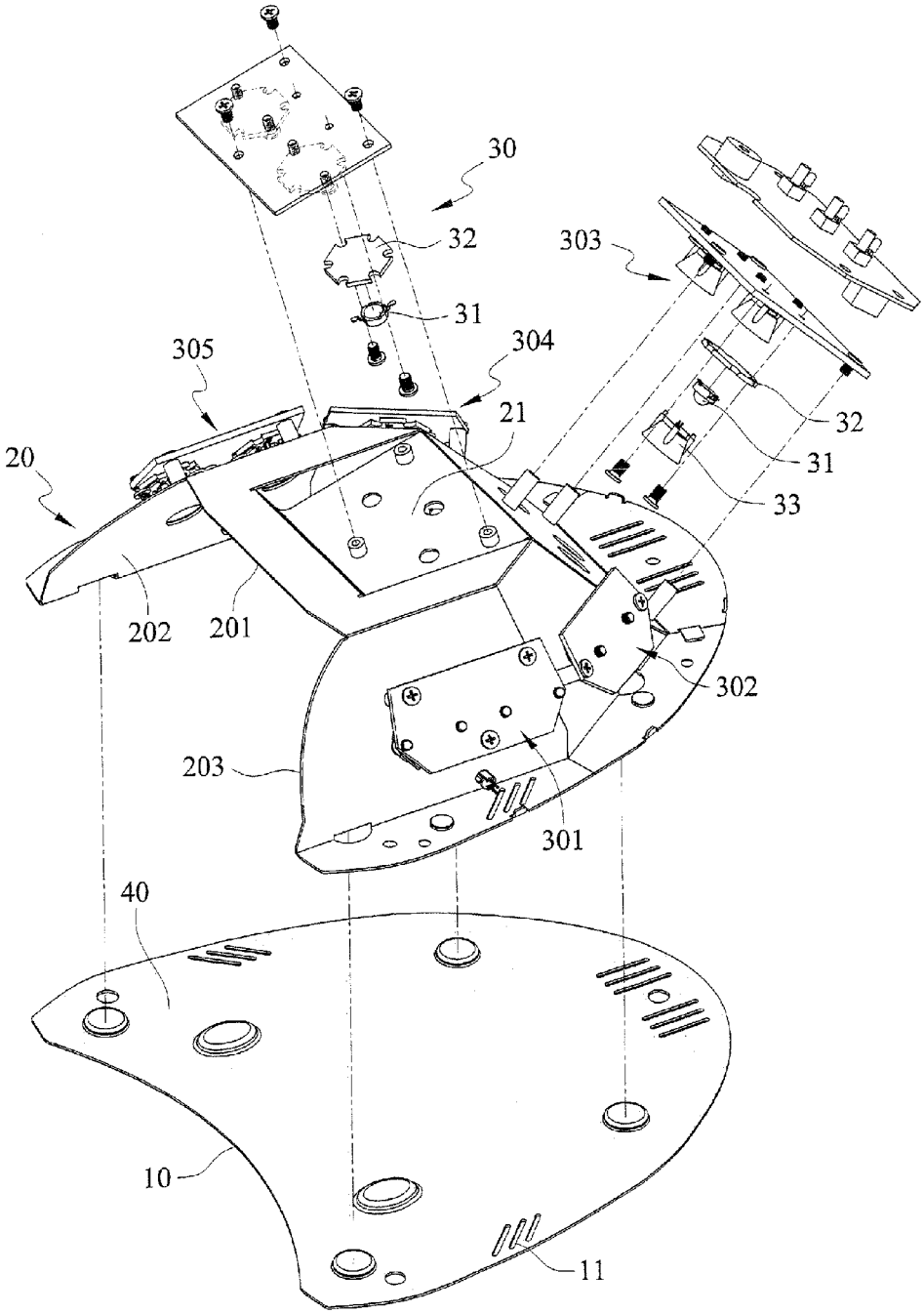
FIG. 2 is an exploded view showing the main components of the lighting apparatus of the present invention.

As shown in FIGS. 1 and 2, the lighting apparatus for nail beauty of the present invention comprises:

- a bottom plate 10 having a shape non-restricted to any specific form and comprising a plurality of perforations 11 provided on lateral sides thereof and a black coating 40 (light absorbing coating) provided on a surface thereof such that light emitted from the top or lateral sides of the bottom plate 10 is not being reflected out of the external of the housing of the lighting apparatus by the bottom plate 10.

Figure 3:
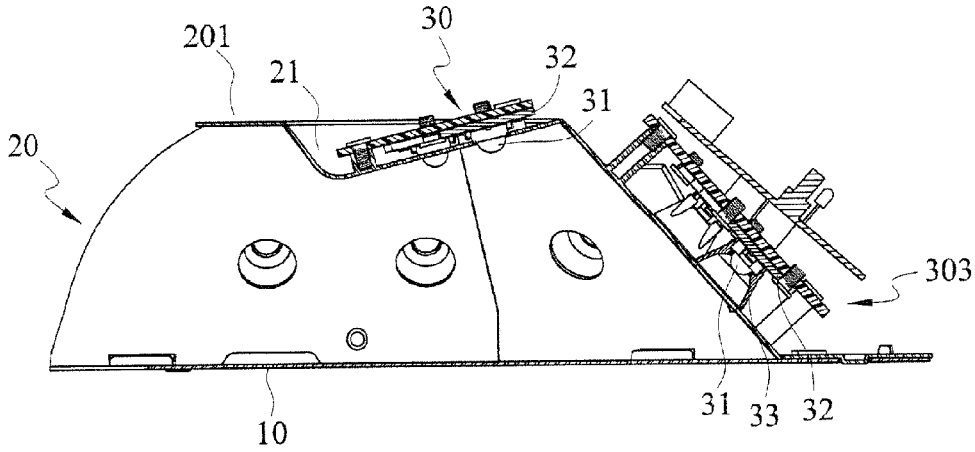
FIG. 3 is a cross sectional view of the lighting apparatus of the present invention.
Figure 4:
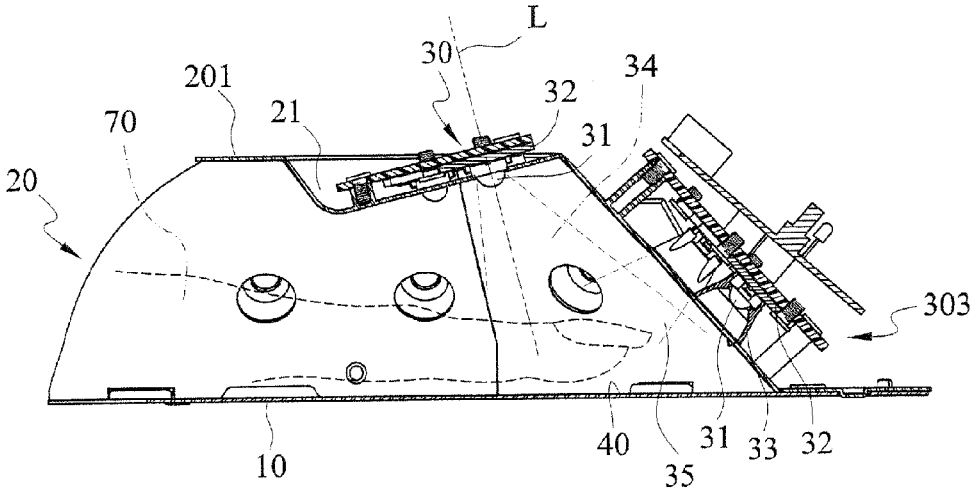
FIG. 4 is a side view showing an illustration of the lighting provided by the lighting apparatus of the present invention during an operation thereof.

As shown in FIGS. 1, 2 and 3, a housing 20 having an arched main body is attached to a top of said bottom plate 10 to form a space between the housing 20 and the bottom plate 10; wherein the top 201 of the housing 20 further comprises an indented portion 21. The indented portion 21 can be either an indent such as a concave slot protruding inward, as shown in FIGS. 1, 2 and 3, or a convex bulge protruding outward (not shown). In addition, an axis L normal to a bottom of said indented portion 21, as shown in FIG. 4, is tilted slightly toward the front end of the lighting apparatus and toward the extended area opposite of the opening of the space formed between the housing 20 and the bottom plate 10.

According to the abovementioned housing 20 of the lighting apparatus for nail beauty of the present invention, an inner surface of the housing 20 may further comprise a black coating (without reference numerals denoted in the figures) to reduce the reflection of light thereon.

A plurality of lighting modules 30, 301, 302, 303, 304, 305 are provided on the top 201 and the two lateral sides 202, 203 of the housing 20 to form a ring array. The lighting modules 30, 301, 302, 303, 304, 305 also comprise light sources 31, preferably for UV light emission, and heat sinks 32. In addition, light converging lenses 33 are provided at the front portions of the light sources 31 of the lighting modules 301, 302, 303, 304, 305 forming the ring array.

The outer surface of the lighting apparatus for nail beauty of the present invention can be configured to be mounted or attached with an outer casing having any shapes and forms in order to form a complete assembly of the lighting apparatus of the present invention. It can be readily understood that the appearance and shape of the outer casing is not the main technical feature of the lighting apparatus of the present invention; therefore, the detailed description of the outer casing is briefly recited here for illustrative purposes only without introducing limitations to the present invention.

Refer now to FIGS. 3 and 4. The main technical feature of the present invention is shown in the figures and includes at least the arrangement or configuration of the lighting modules 30 provided on the top 201 of the housing. The light emitted by these lighting modules 30 is shone toward a front end of the lighting apparatus and toward an extended area opposite of the opening of the space formed between the housing 20 and the bottom plate 10. In order to achieve such lighting design, the lighting modules 30 are preferably attached onto and mounted against the indented portion 21 configured on the top 201 of the housing 20 such that a firm structure of the lighting modules 30 can also be constructed.

Figure 5:
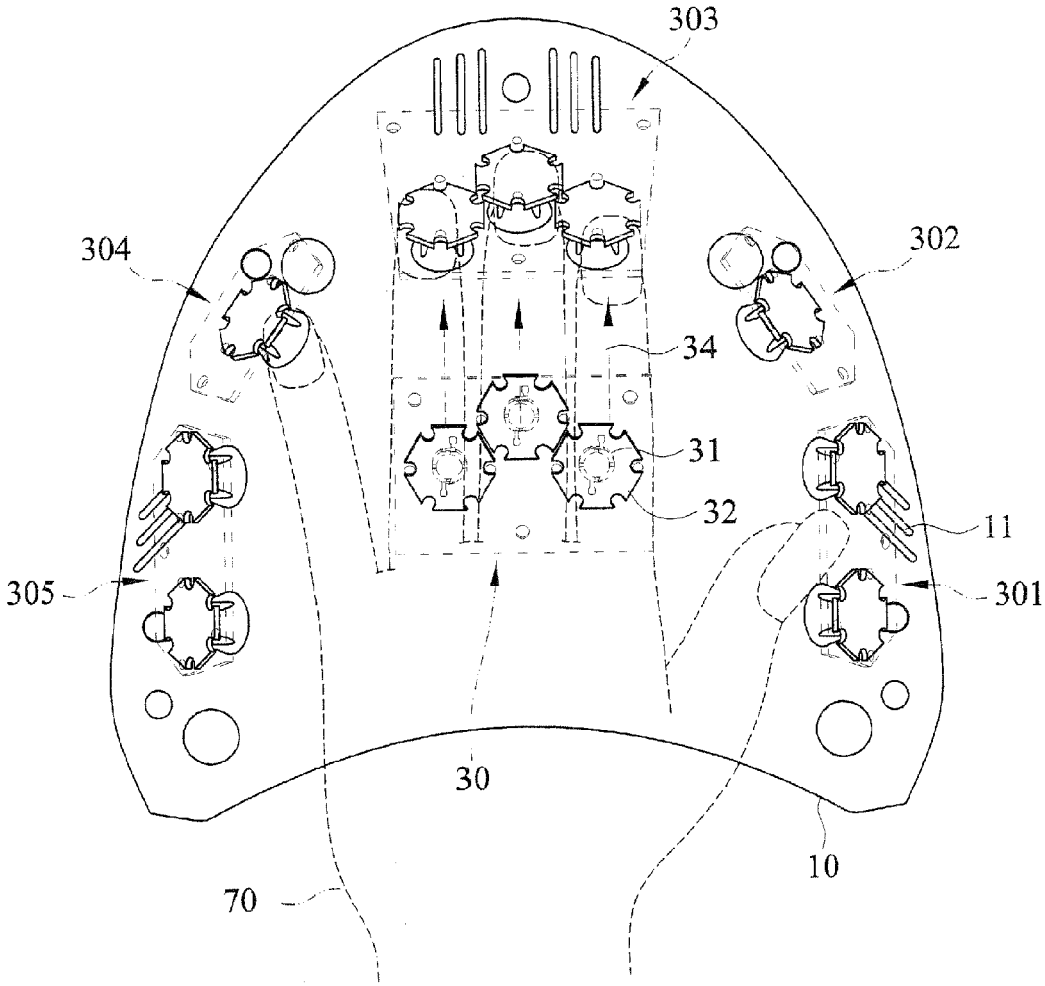
FIG. 5 is a top view showing an illustration of the lighting provided by the lighting apparatus of the present invention during an operation thereof.
Figure 6:
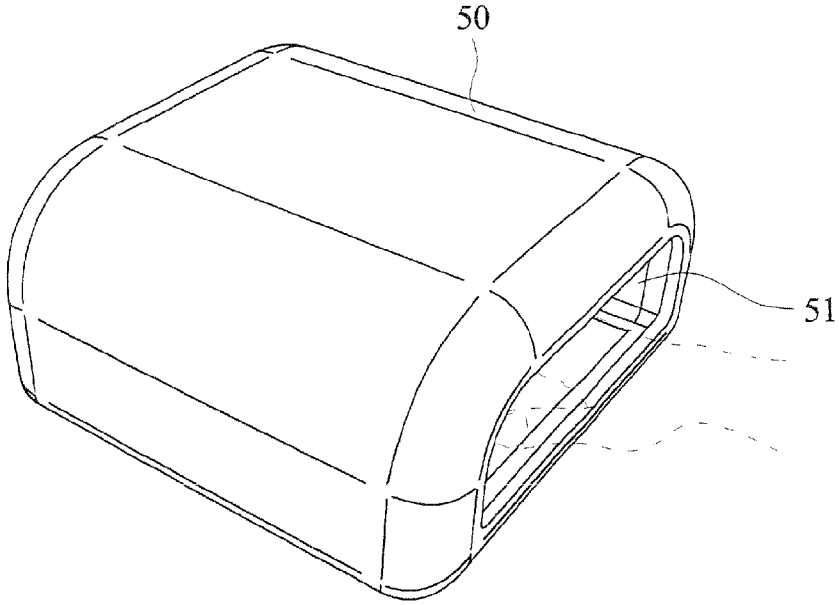
FIG.6 PRIOR ART
FIG. 6 is a perspective view of a known lighting device.
Figure 7:
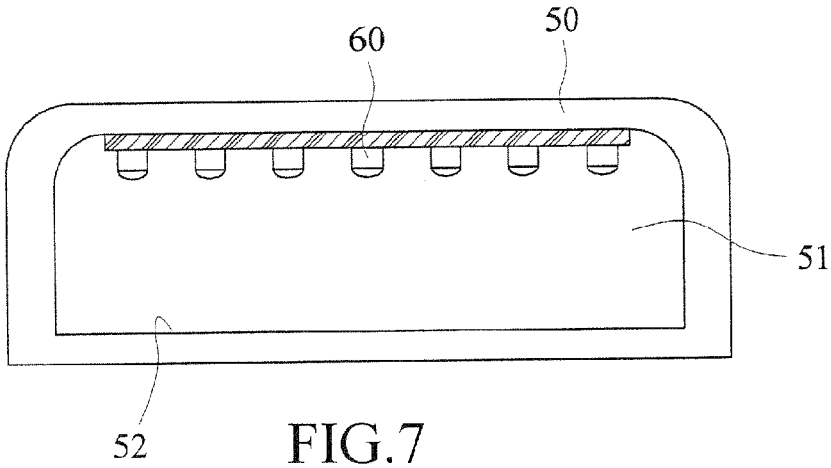
FIG.7 PRIOR ART
FIG. 7 is a cross sectional view of the known lighting device.

During the operation of the lighting apparatus for nail beauty of the present invention, as shown in FIGS. 4 and 5, user's hand 70 (or foot) having nails furnished with nail polishes or paintings of nail arts for curing is placed inside the space formed between the housing 20 and the bottom plate 10 of the lighting apparatus. The lighting modules 301, 302, 303, 304, 305 forming the ring array on the housing 20 would then be turned on to provide lighting shone toward the nails during the operation. In addition, the lighting modules 30 provided on the top 201 of the housing 20 would also be able to provide lighting tilted slightly to shone toward the front end of the lighting apparatus and the light rays 34 are being projected onto the nails in conjunction with the light rays 35 projected by the other lighting modules 301, 302, 303, 304, 305 such that the nails with natural curvatures can receive a uniform lighting and such that the nail polishes or achieves of the nail arts can be cured into solid forms rapidly.

In terms of the operation and usage of the lighting apparatus for nail beauty of the present invention, said lighting apparatus for nail beauty includes at least the following merits of 1. The ring array formed by the lighting modules can provide an on-spot lighting in accordance with the arrangement and location of the nails; in addition, as the top lighting modules capable of providing light rays projected from the above are being tilted slightly to shone toward the front end of the lighting apparatus, a uniform lighting onto the nails with natural curvatures can be achieved, and as a result, rapid lighting for curing can be accomplished. Under an actual test of the lighting apparatus for nail beauty of the present invention, the test result shows that a short time duration of 10 seconds can be achieved, which greatly reduces the time required for curing with the light and is considered to be the major improved effects of the lighting apparatus for nail beauty of the present invention;
2. The abovementioned structural design of the lighting modules requires less light sources, which in turn reduces the costs and increases the efficiency of the lighting apparatus. Under an actual test of the lighting apparatus for nail beauty of the present invention, the test result shows that the lighting apparatus requires only 10 watts of power. In addition, the lighting from the lighting apparatus introduces no burning to the users. In comparison to the conventional matrix arrangement of light sources, the lighting design and structural configuration of the lighting apparatus of the present invention are of greater lighting efficiency and outcome;
3. As the surface of the bottom plate as well as the inner surface of the housing of the lighting apparatus for nail beauty of the present invention are provided with black coatings to prevent reflection of light, the UV light cannot be reflected out of the lighting apparatus easily such that the dangers of having the arm, face or eyes of the user being exposed to UV light can be eliminated for a safer use of the lighting apparatus; and
4. While using less light sources in the lighting design and structural configuration of the lighting apparatus for nail beauty of the present invention, the lighting apparatus can be of a better heat dissipation as a whole with the incorporation of the designs of heat sinks and air ventilation holes, which makes the lighting apparatus to function and to operate better as another merit of the present invention.

What is claimed is:

1. A lighting apparatus for nail beauty, comprising:

a bottom plate;

a housing having an arched main body attached to a top of said bottom plate to form a space therebetween;

a plurality of lighting modules provided on a top and two lateral sides of said housing to form a ring array; wherein said lighting modules comprise light sources and heat sinks; and wherein said lighting modules provided on said top of said housing are tilted slightly such that light emitted therefrom is shone toward a front end of said lighting apparatus and toward an extended area opposite of an opening of said space formed between said housing and said bottom plate.

2. The lighting apparatus for nail beauty according to claim 1, wherein said top of said housing further comprises an indented portion; and wherein an axis normal to a bottom of said indented portion is tilted slightly toward said front end of said lighting apparatus and toward said extended area opposite of said opening of said space formed between said housing and said bottom plate.

3. The lighting apparatus for nail beauty according to claim 2, wherein said indented portion on said top of said housing is of a concave shape protruding inward from an external of said lighting apparatus.

4. The lighting apparatus for nail beauty according to claim 2, wherein said indented portion on said top of said housing is of a convex shape protruding outward from an internal of said lighting apparatus.

5. The lighting apparatus for nail beauty according to claim 1, wherein an inner surface of said housing comprises a black coating.

6. The lighting apparatus for nail beauty according to claim 1, wherein a surface of said bottom plate comprises a black coating.

* * * * *